US006035623A

United States Patent [19]

Wassenhoven et al.

[11] Patent Number: 6,035,623

[45] Date of Patent: Mar. 14, 2000

[54] OPEN-END SPINNING DEVICE WITH REPLACEABLE CONDUIT PLATE ADAPTER

[75] Inventors: Heinz-Georg Wassenhoven; Konrad-Georg Schulz, both of Monchengladbach; Helmut Jakobs, Niederkruchten; Jochen Dressen, Monchengladbach, all of Germany

[73] Assignee: W. Schlafhorst AG & Co., Moenchengladbach, Germany

[21] Appl. No.: 09/112,551

[22] Filed: Jul. 9, 1998

[30] Foreign Application Priority Data

Jul. 9, 1997 [DE] Germany ..... 197 29 192

[51] Int. Cl.[7] ..... D01N 4/00

[52] U.S. Cl. ..... 57/406; 57/407; 57/408; 57/413; 57/417

[58] Field of Search ..... 57/352, 404, 406, 57/407, 408, 411, 413, 417

[56] References Cited

U.S. PATENT DOCUMENTS

| | | | |
|---|---|---|---|
| 4,796,421 | 1/1989 | Stahlecker et al. | 57/417 |
| 4,854,119 | 8/1989 | Stahlecker et al. | 57/417 |
| 5,402,630 | 4/1995 | Stephen et al. | 57/417 |
| 5,638,671 | 6/1997 | Stahlecker et al. | 57/417 |
| 5,778,654 | 7/1998 | Stahlecker | 57/407 |
| 5,787,699 | 8/1998 | Morishita et al. | 57/404 |
| 5,794,430 | 8/1998 | Grescksch et al. | 57/404 |

FOREIGN PATENT DOCUMENTS

| | | | |
|---|---|---|---|
| 592866 | 4/1994 | European Pat. Off. | 57/417 |
| 43 34 485 A1 | 4/1995 | Germany . | |
| 195 24 837 A1 | 1/1997 | Germany . | |
| 195 44 617 A1 | 6/1997 | Germany . | |

*Primary Examiner*—William Stryjewski
*Attorney, Agent, or Firm*—Kennedy Covington Lobdell & Hickman, LLP

[57] ABSTRACT

An open-end spinning device having a spinning rotor housed within a rotor housing which includes a yarn conduit plate for closing the front side of the rotor housing and a conduit plate adapter, defining a mouth area of a yarn conduit guide and including a yarn draw-off jet, which is removeably arranged in a receptacle of the yarn conduit plate and is easily and quickly replaced in connection with the replacement of a rotor, while providing a reliable and tight fastening of the conduit plate adapter in the open-end spinning device. The conduit plate adapter comprises an extension including fixing elements which can be secured by a fixing arrangement which is movably arranged for selectively abutting the fixing elements for fixing the conduit plate adapter within the receptacle of the yarn conduit plate. The fixing arrangement preferably comprises a slide or a double-bar spring which surround the extension of the conduit plate adapter and include beveled contact surfaces and a biasing device for securely fixing the conduit plate adapter in the receptacle of the yarn conduit plate.

18 Claims, 9 Drawing Sheets

OPEN-END SPINNING DEVICE WITH REPLACEABLE CONDUIT PLATE ADAPTER

FIELD OF THE INVENTION

The present invention relates generally to an open-end spinning device having a spinning rotor which is housed within a rotor housing and includes a yarn conduit plate for closing the front side of the rotor housing and more particularly to a conduit plate adapter replaceably arranged in a receptacle of the yarn conduit plate and defining a mouth area of a yarn guide conduit and including a yarn draw-off jet.

BACKGROUND

Such open-end spinning devices are, for example, known from German Patent Publication DE 43 34 485 A1 which discloses a typical open-end spinning unit with a yarn conduit plate and a conduit plate adapter. The yarn conduit plate closes the front side of the rotor housing and is part of a pivotable cover forming a part of a spinning box housing assembly which covers the entire front side of the spinning box and additionally carries an intake roller and an opening device for the sliver as well as a soil separation chamber. The yarn conduit plate can be an integral component or a detachable part of the pivotable cover. The conduit plate adapter is removeably positioned in the yarn conduit plate. The conduit plate adapter contains a part of a yarn guide conduit, a yarn draw-off jet and a connection to a yarn draw-off tube.

In order to assure a precise yarn infeed and an optimal yarn draw-off, conduit plate adapters are coordinated with a certain rotor shape and size. Upon a yarn batch change, the rotor must also be replaced. Thus, the conduit plate adapter is replaced by a conduit plate adapter which is compatible with the new rotor.

Various fastening devices have been suggested to simplify the replacement of the conduit plate adapter. For example, German Patent Publication DE 43 34 485 A1 teaches fastening the conduit plate adapter with screws to the conduit plate. However, a disadvantage of this type of device is that it requires the use of tools. A fastening device for a conduit plate adapter which can be replaced without tools is described in German Patent Application DE 195 24 837 A1. The conduit plate adapter comprises a conical bearing body which is inserted into a corresponding conical receptacle of the onduit plate. In this device, a bar spring engages on one side into a tangential groove in the conical bearing body to fasten the conduit plate adapter. The conduit plate adapter is released by bending the spring back. While the conduit plate adapter may be fastened and released without tools, one disadvantage of this design is that the off-center introduction of force by the spring at one side of this device can cause a tilting of the conical bearing body of the conduit plate adapter and may cause leaks which result in the undesirable inflow of infiltrated air into the spinning chamber.

SUMMARY OF THE INVENTION

Based on the above-mentioned prior art, it is an object of the present invention to provide a means for improving the fastening of conduit plate adapters in open-end spinning devices.

The present invention is basically applicable to essentially any open-end spinning device comprising a rotor housing having an open front side and including a spinning rotor rotating within the rotor housing and a yarn conduit plate for closing the open front side of the rotor housing. The yam conduit plate includes a receptacle and a conduit plate adapter removeably positioned in the receptacle which defines a mouth area of a yarn conduit guide and includes a yarn draw-off jet. In accordance with the present invention, the foregoing object is attained by providing the open-end spinning device with a conduit plate adapter comprising, viewed in the direction of installation, an extension which includes fixing elements and a fixing means comprising a moveable fastening device for loading the fixing elements in place. The conduit plate adapter includes a body having contact surfaces which engage the yarn conduit plate within the receptacle when the conduit plate adapter is positioned in the receptacle. An advantageous design of the conduit plate adapter provides for the fixing elements to be secured by the fastening device so that the conduit plate adapter is uniformly fixed within the receptacle to avoid a tilting of the body and the contact surfaces of the conduit plate adapter. Thus, the conduit plate adapter rests evenly within the receptacle and the uniform contact of the contact surfaces with the receptacle effectively prevents the entry of infiltrated air.

While the conduit plate adapter of the present invention designed to be easily and quickly installed for use and removed for replacement, the installed conduit plate adapter is also reliably secured in the receptacle.

In the present invention, the fixing means is arranged to extend under the fixing elements on opposite sides of the extension of the conduit plate adapter. The fixing elements extend essentially orthogonally to the longitudinal axis of the extension and past the circumference of the extension. In addition, the extension may include opposing grooves which can be connected to each other by further indentations to form a circumferential, continuous groove. This continuous groove may be easily manufactured, for example, on a turned part like the extension. Thus, the fixing elements of the present invention are simple to manufacture and the fixing means for fastening the conduit plate adapter is similarly simple in design.

In a first and a second preferred embodiment, the fixing means comprises a slide and a double-bar spring, respectively, which surround the extension of the conduit plate adapter closely adjacent opposite sides thereof in a fork-like manner with the fixing elements abutting the adjacent surfaces of the slide or the double-bar spring to securely hold the extension of the conduit plate adapter. The fixing elements are released by simply shifting the slide or spreading the double bar spring for quickly and easily replacing the conduit plate adapter.

In order to provide an especially firm and reliable seat for the conduit plate adapter, the contact surfaces may be beveled or chamfered in a wedge-shaped fashion. In the first preferred embodiment, the contact surfaces of the fixing elements and/or the portions of the slide which extend under the fixing elements are beveled in a wedge-shaped fashion. As the slide is moved to a fixed position for securing the fixing elements, the beveled contact surfaces cause a force to be exerted in the direction of installation of the conduit plate adapter with the force increasing as the slide continues to be moved to its fixed position. The effect of the beveling is additionally increased if the rises of the beveled contact surfaces, which face each other, of the fixing elements and the slide run in the same direction so that the fixing elements glide in a rising fashion on the slide.

In the first preferred embodiment, the slide is urged into its fixed position by a biasing means, such as, by way of example, a spring. Because the spring automatically biases the slide toward and holds it in its fixed position, the present invention provides a simple and effective design.

In the second preferred embodiment where the conduit plate adapter is fastened by the double-bar spring, the firmness and reliability of the seat of the conduit plate adapter can also be improved by beveling the contact surfaces of the fixing elements. As in the first preferred embodiment, the beveled contact surfaces glide in a rising fashion on the double-bar spring.

The second preferred embodiment of the present invention provides a spreading element for spreading the double-bar spring between a spread or release position for releasing the conduit plate adapter from the receptacle and a fixed position for securing the conduit plate adapter in the receptacle. The preferred spreading element includes a rotary toggle for easily actuating the spreading element and includes a biasing means, such as, by way of example, a spring, so that in the non-actuated state, the spreading element is automatically rotated into and normally held in its fixed position. Utilizing this design, the possibility of an unintentional release of the conduit plate adapter is practically eliminated. Thus, the present invention provides a conduit plate adapter which includes a simple and effective fastening means for improving the fastening of the conduit plate adapter in an open-end spinning device.

Further details of the invention will be understood from an exemplary embodiment described below with reference to the accompanying drawings.

DETAILED DESCRIPTION OF THE PREFERRED EMBODIMENT

Figure 1:
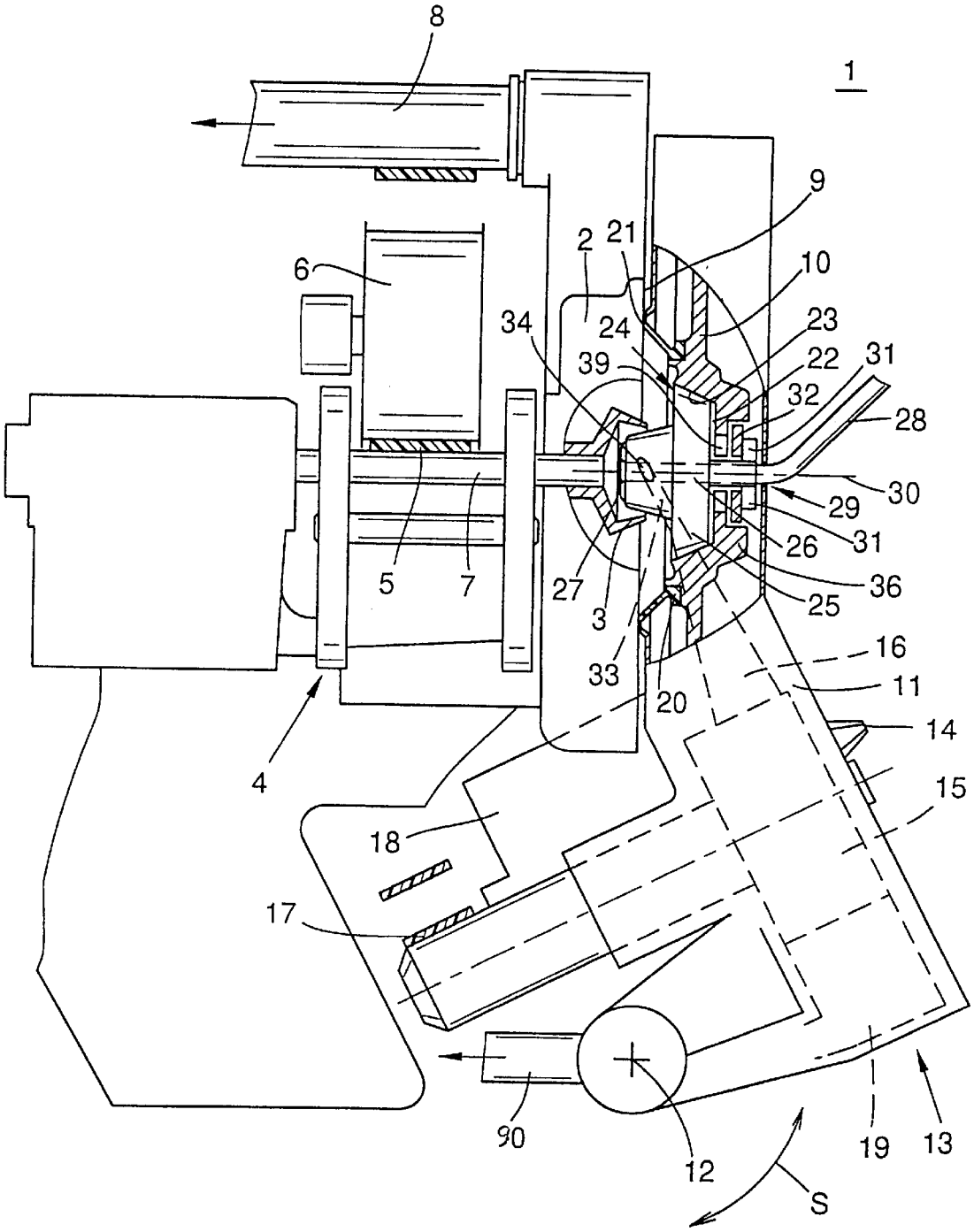
FIG. 1 is a side elevation, partially in cross-section, of an open-end spinning device with a pivot housing covering the front side of the spinning box and a conduit plate adapter inserted in the yarn conduit plate closing the rotor housing, in accordance with the present invention.

Referring now to the accompanying drawings and initially to FIG. 1, an open-end spinning device is generally designated by the numeral 1 and includes a rotor housing 2 in which a spinning rotor 3 rotates at a high speed. As is customary, the spinning rotor 3 is supported on a support-disk bearing 4 and is driven by a tangential belt 5 which extends along the spinning machine and is pressed against a rotor shaft 7 by a pressure roller 6. In order to produce the spinning vacuum which transports the yarns into the rotor 3, the rotor housing 2 is connected via a tube 8 to a vacuum-producing system (not shown here).

As shown in FIG. 1, the rotor housing 2 is closed on its front side 9 by a yarn conduit plate 10 which is part of a pivot housing 11 which receives other units of the open-end spinning device 1. The yarn conduit plate 10 can be a component of pivot housing 11 or is detachably fastened to it. Pivot housing 11 is mounted so that it can pivot about pivot axis 12, as is indicated by double arrow S in FIG. 1.

An opening device 13 is built into the pivot housing 11. The sliver drawn into the opening device 13 is supplied to an opening cylinder 15 via an intake roller 14 (not shown in detail here) and the individualized yarns are drawn by suction through a yarn guide conduit 16 into the rotor 3. The opening cylinder 15 is preferably driven by a tangential belt 17 and by a drive shaft running the length of the machine or by an electromotor individual drive 18. Moreover, a soil separation chamber 19 is located in the pivot housing 11 below the opening cylinder 15 for collecting the soil which accumulates during the opening of the sliver. The soil separation chamber 19 is connected via a tube 90 to the central suction device of the machine.

The yarn conduit plate 10 of the pivot housing 11 includes an annular shoulder for positioning a lip sealing element 21. The yarn conduit plate 10 also comprises a receptacle 22 open in the direction of rotor housing 2 and includes a lateral contact surface 23 within the receptacle 22. The lateral contact surface 23 is preferably annular in the shape of a truncated cone with the wider portion of the cone adjacent to the rotor housing 2. This shape helps to prevent leaks which occur due to an improper fit when the conduit plate adapter 24 is inserted in the receptacle 22. The wall of lateral contact surface 23 of receptacle 22 on the side of the yarn conduit plate 10 facing away from the rotor 3 may extend to form a convexity 36 shaped substantially like a truncated cone. The conduit plate adapter 24 includes an upper body portion 25 which is of a truncated conical shape adapted to conform to the shape of the receptacle 22 to be inserted and aligned in an angularly precise manner therein.

As is typical, the conduit plate adapter 24 includes a central bore 26 for a yarn draw-off jet 27 opposite the rotor 3 and for the connection of a yarn draw-off tube 28, which is formed by an extension 29 of the insertion body 25. Furthermore, an extension 33 of the yarn guide conduit 16, which empties into an opening 34, passes through the conduit plate adapter 24. The yarn conduit plate 10 includes a means 32 for releasably fixing the conduit plate adapter 24 in place on the yarn conduit plate 10. As described in more detail subsequently, the fixing arrangement 32 extends under a pair of fixing elements 31 which are positioned to extend essentially orthogonally to a longitudinal axis 30 of the extension 29.

Two preferred embodiments of the fixing means are provided in accordance with the present invention. FIGS. 2 to 5 illustrate a first preferred embodiment of the present invention in which the fixing means comprises a slide having a slotted region through which the extension 29 of the conduit plate adapter 24 is received and surrounded and by which the slide can be moved slidably between the fixing elements 31 and the yarn conduit plate 10.

Figure 6:
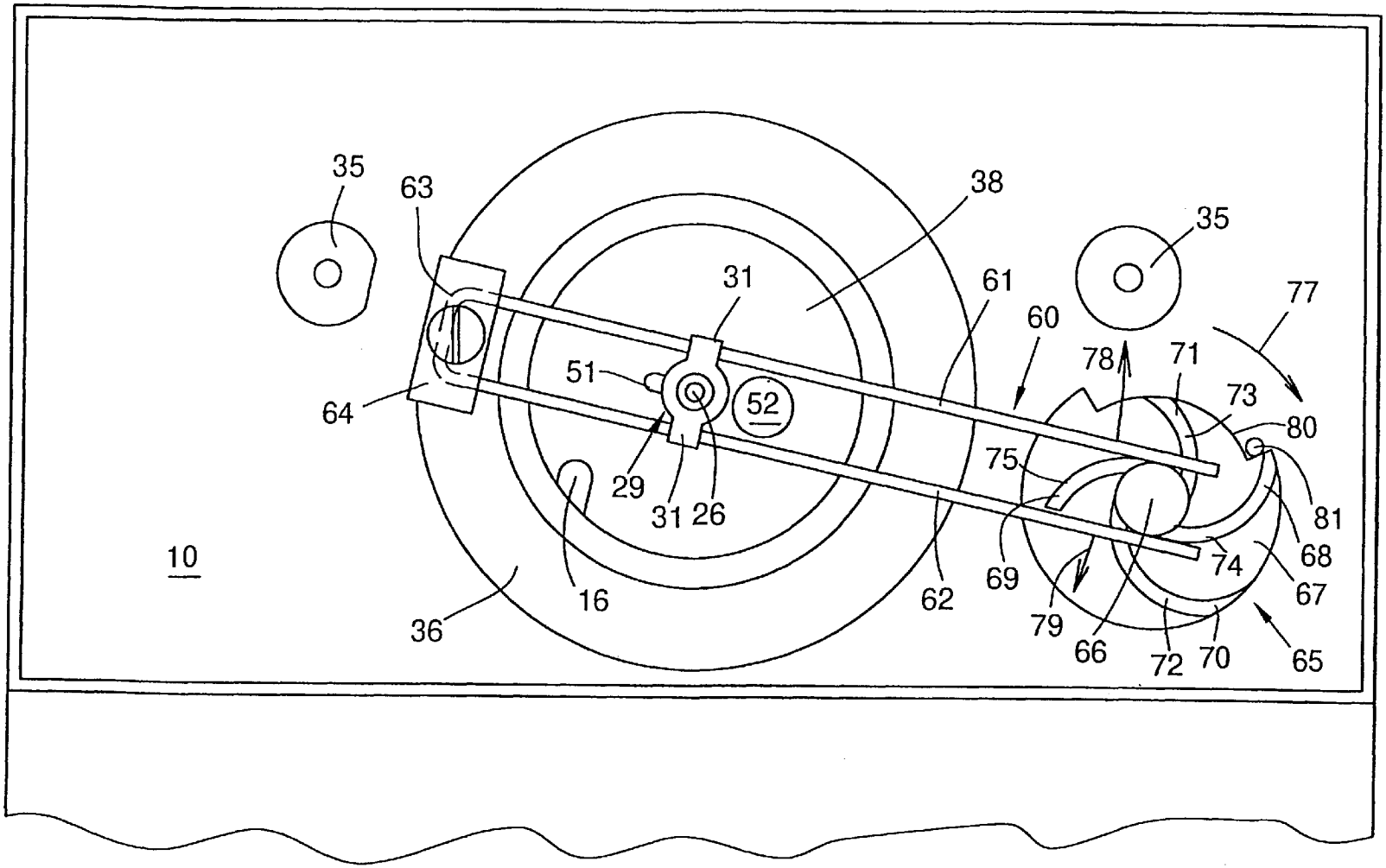
FIG. 6 is a top view of the side of the yarn conduit plate illustrating a double-bar spring arranged as a fixing means of the conduit plate adapter with the double-bar spring in its fixed position, in accordance with the second preferred embodiment of the present invention.
Figure 7:
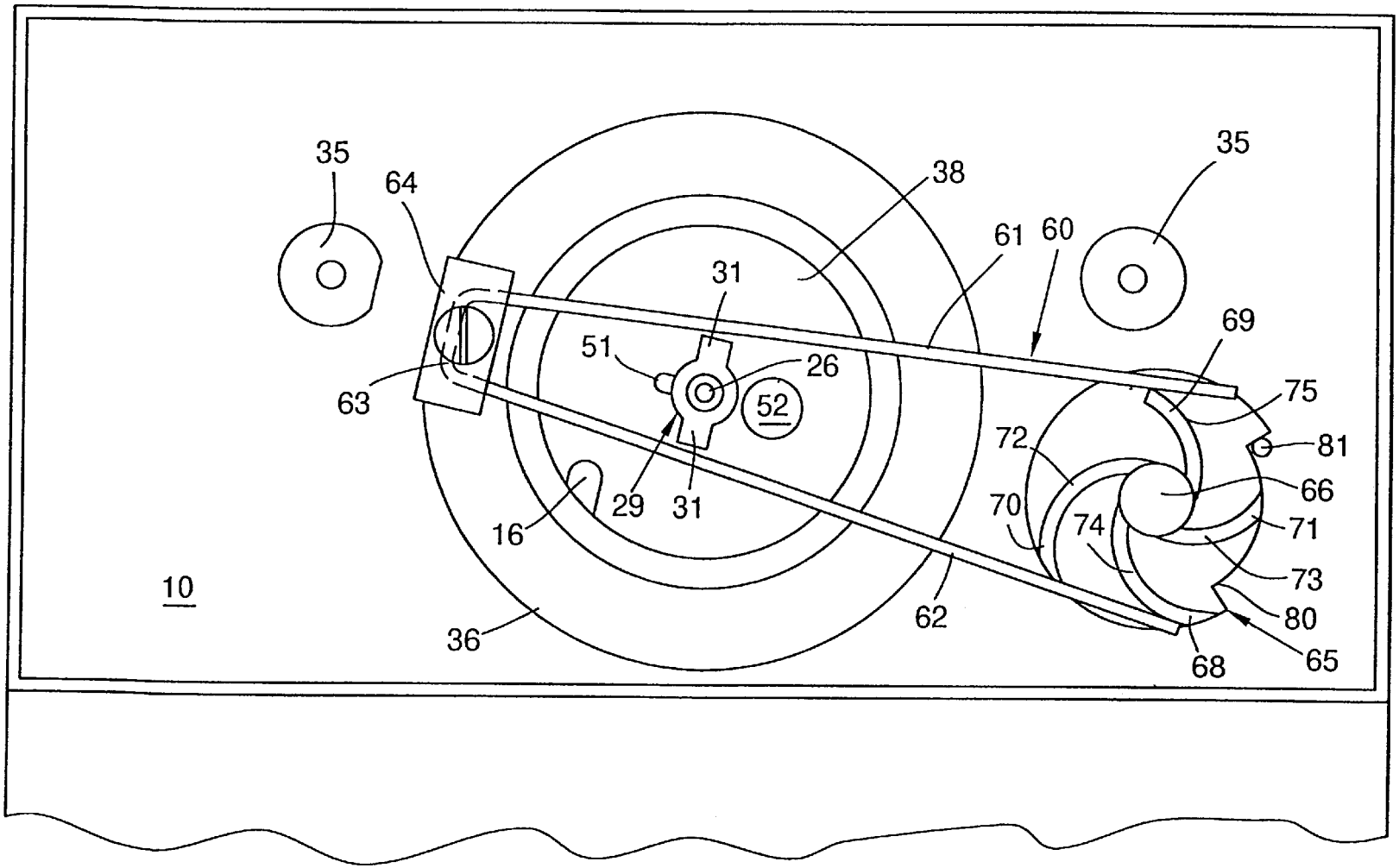
FIG. 7 is a top view illustrating the double-bar spring in a spread or release position.
Figure 8:
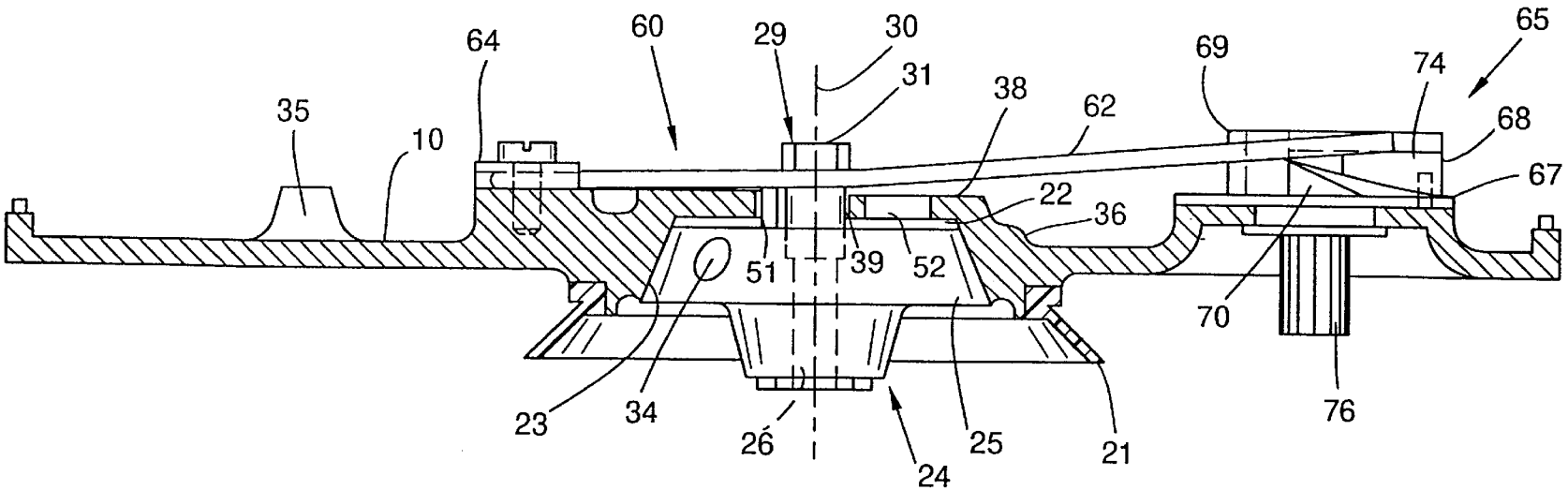
FIG. 8 is a cross-sectional view through the yam conduit plate along the double-bar spring located in the fixing position.

FIGS. 6 to 8 illustrate a second preferred embodiment of the present invention in which the fixing means is a double-bar spring whose two spring bars are selectively insertable and removable from under the fixing elements 31.

Figure 9:
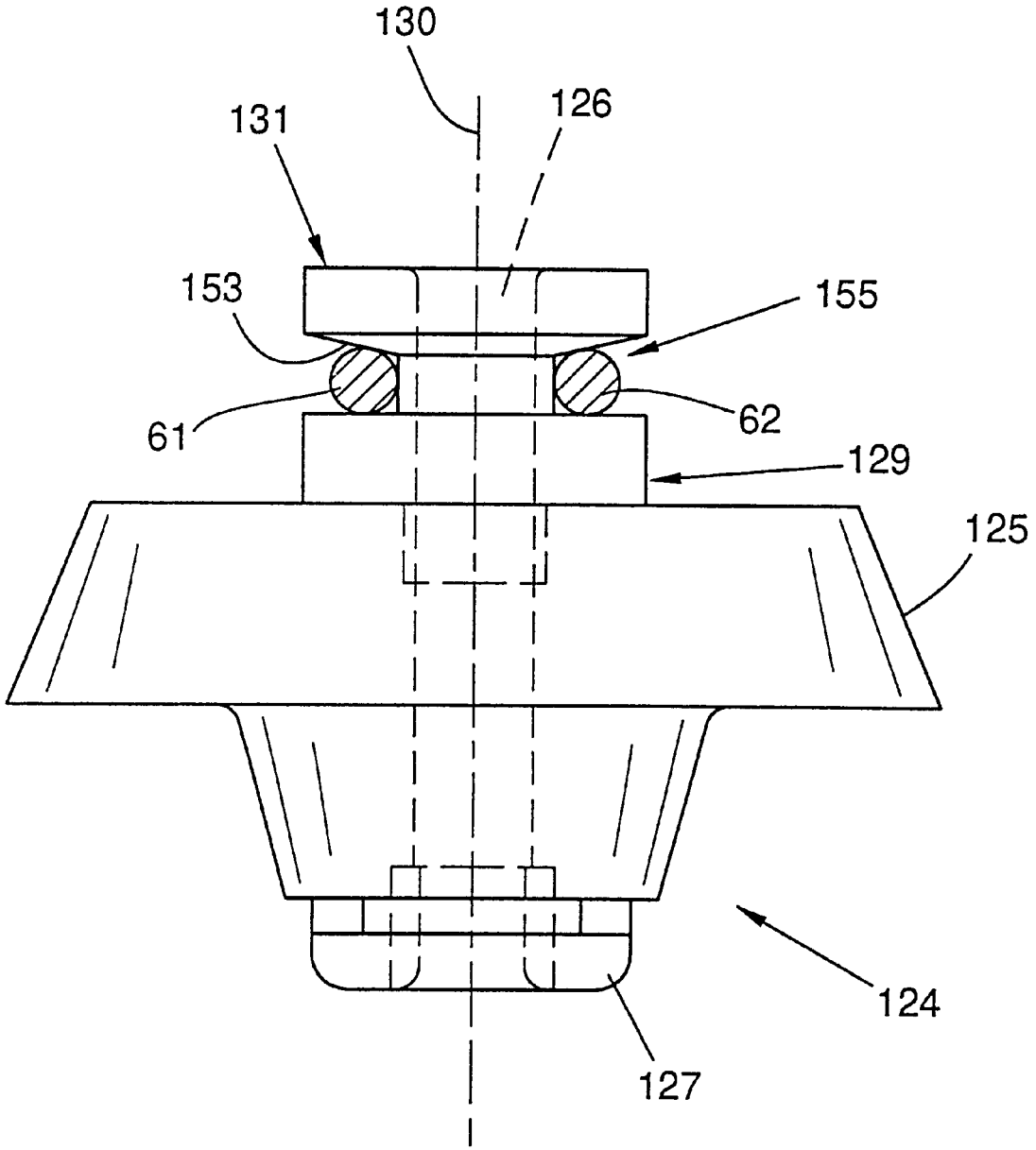
FIG. 9 is a side view of a conduit plate adapter illustrating the fixing elements of another preferred embodiment of the present invention a variation of the first preferred embodiment which include a groove.

FIG. 9 illustrates another preferred embodiment of the present invention in which the fixing elements 131 are formed in connection with a groove or grooves in an extension 129 which has a truncated-cone shape.

Figure 2:
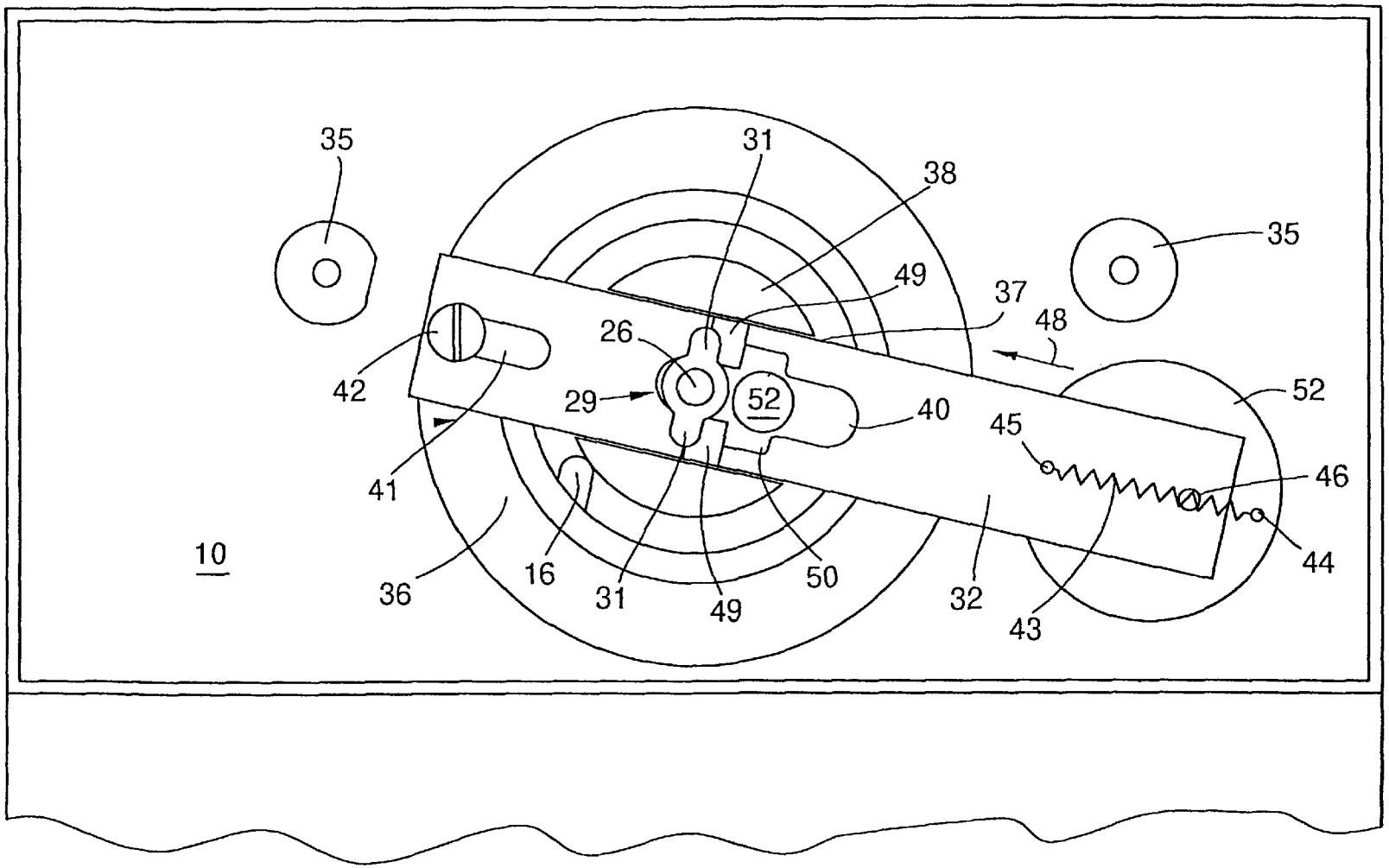
FIG. 2 is a top view of the side of the yarn conduit plate illustrating a slide arranged as a fixing means of the conduit plate adapter and showing the slide in its fixed position, in accordance with the first preferred embodiment of the present invention.

Referring now specifically to FIG. 2, the yarn conduit plate 10 is shown with the slide 32 of the first preferred embodiment arranged thereon. The yarn conduit plate 10 has been removed from the pivot housing 11 and the numeral 35 designates the threadings into which the screws for securing the yarn conduit plate 10 to the pivot housing 11 can be fastened.

Figure 3:
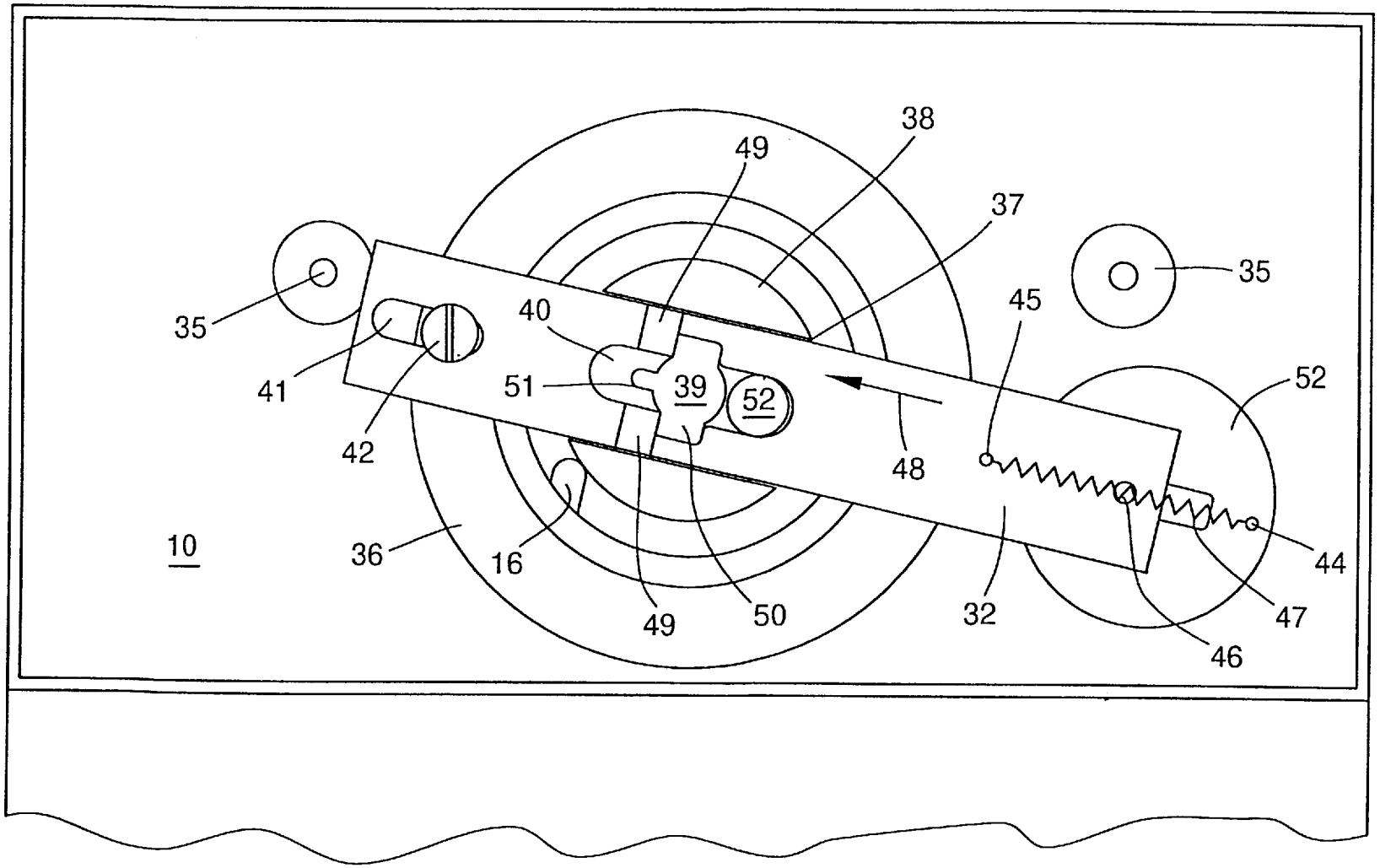
FIG. 3 is a top view of the side of the yarn conduit plate illustrating a slide in a release position with the conduit plate adapter removed.

In the top view of FIG. 2, a portion of the yarn guide conduit 16 can be seen opening inwardly through the central portion convex 36 of the yarn conduit plate 10 which defines the truncated conical receptacle 22 for the conduit plate adapter 24. The convex portion 36 forms a bottom surface 38 of the receptacle 22 and the slide 32 is guided in a groove 37 in the bottom 38 of the receptacle 22. The extension 29, which includes the bore 26 for the yarn draw-off and the connection of the yarn draw-off tube 28, passes through the bottom 38 in an opening 39 (see FIG. 1) in the yarn conduit plate 10. As seen in FIGS. 2 and 3, the slide 32 comprises an oblong hole 40 through which the extension 29 extends so that it is surrounded on either side by the slide 32 in a fork-like manner. The slide 32 is thrust between the bottom 38 and the fixing elements 31 and positions the conduit plate adapter 24 in the receptacle 22 in this manner. The fixing elements 31 engage opposing contact surfaces 49 formed on the slide 32 at opposite sides of the hole 40. Dimensional tolerances can be compensated by the wedge-shaped beveling of the contact surfaces 49 on the slide 32 so that a clamping action is achieved.

The slide 32 comprises another oblong hole 41 on one end which provides guidance for a fastening means 42, such as, by way of example, a screw bolt. A traction spring 43 is provided on the other end of the slide 32 and includes a fastening point 44 on the yarn conduit plate 10 on one end and a fastening point 45 on the slide 32 on the other end for fastening the spring 43 to the slide 32 and the yarn conduit plate 10.

As shown in FIG. 3, the slide 32 can be shifted in the direction of arrow 48 by means of an actuator 46 (see also FIG. 4) which extends through a slot 47 in the side of the yarn conduit plate 10 facing away from the observer and is connected to the slide 32. As a result, the spring 43 is tensioned when the actuator 46 is actuated to thrust the slide 32 away from under the fixing elements 31 in the direction of the arrow 48. The actuator 46 rests in a convexity 52, facing away from the observer, in the underside of the yarn conduit plate 10, on which the slide 32 is supported. The oblong hole 40 in the slide 32 includes a widened area 50. When the slide 32 is moved in the direction of the arrow 48 by the actuator to a position where the widened area 50 reaches the fixing elements 31, the conduit plate adapter 24 is released and can be removed (as represented in FIG. 3), for example, to be replaced after a rotor replacement by another conduit plate adapter which is coordinated with the replacement rotor.

As can been seen in FIGS. 2 and 3, the slide 32 is moveable between a fixed position for securing the conduit plate adapter 24 in the receptacle 22 during normal spinning operation as shown in FIG. 2, and a release position in which the conduit plate adapter may be removed, as shown in FIG. 3, for replacement. The opening 39 in the bottom 38 of the receptacle 22 of the conduit plate adapter 24 for the passage of the extension 29 can be seen through the widened area 50 of the oblong hole 40. Furthermore, a recess 51 formed by a widened-out area of the opening 39 is included and engages a positioning means, for an angularly precise installation of the conduit plate adapter 24, which is comparable to the positioning means described in German Patent Publication DE 43 34 485 A1.

The present invention also includes an opening 52 in the bottom 38 of the receptacle 22 to which constant communication is provided by the oblong hole 40. The opening 52 communicates with a through air line (not shown) in the conduit plate adapter 24 through which air can be conducted into the rotor housing 2 and into the rotor 3, particularly in conjunction with the start of spinning and in order to clean the rotor and to control the infeed of yarn.

Figure 4:
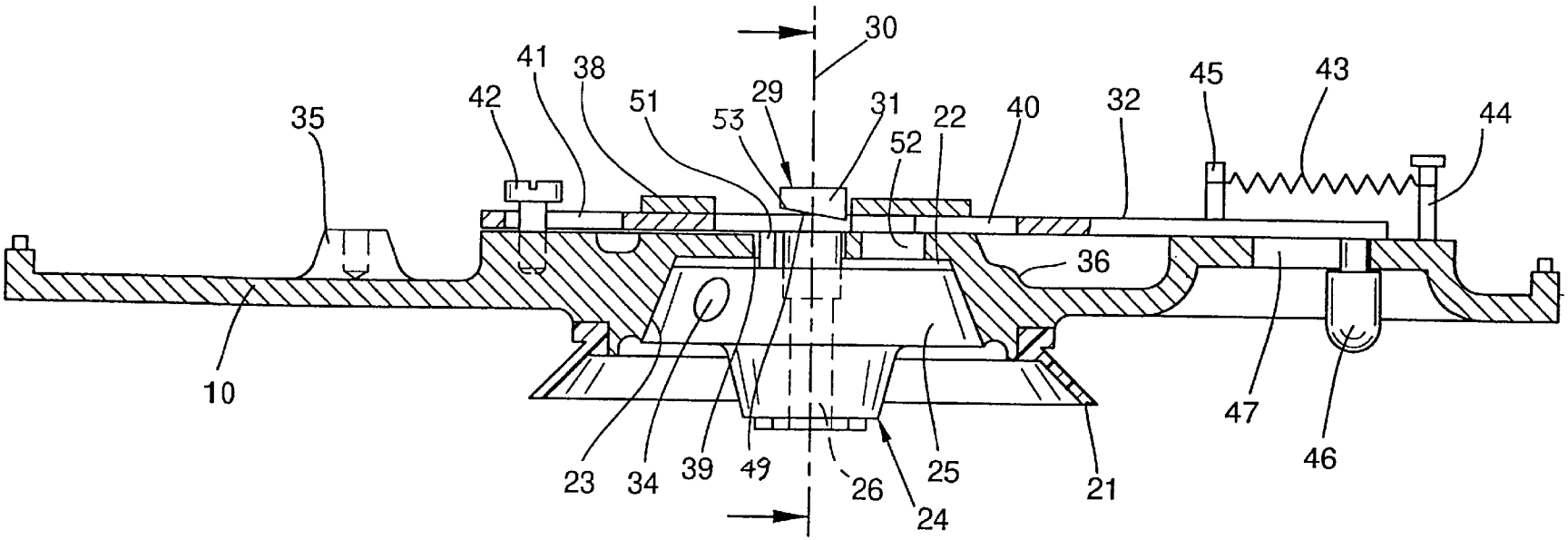
FIG. 4 is a longitudinal cross-sectional view through the yarn conduit plate in the longitudinal direction of the slide.

Referring now specifically to FIG. 4, the contact surfaces 49 of the slide are beveled to have a wedge-shape. The fixing elements 31 include contact surfaces 53 which face the contact surfaces 49 and are also beveled to correspond to the wedge-shaped beveling of the contact surfaces 49. In the preferred embodiment, the rises of the beveled contact surfaces 49, 53 facing each other run in the same direction. In use, after the conduit plate adapter 24 has been inserted into the receptacle 22, the contact surfaces 53 of the fixing elements 31 slide upward on the contact surfaces 49 of the slide 32 when the slide 32 is actuated. As a result, the insertion body 25 of the conduit plate adapter 24 is increasingly pressed against the contact surface 23 of the conically formed receptacle 22. This assures a firm and tight seat of the conduit plate adapter 24 in the receptacle 22.

Figure 5:
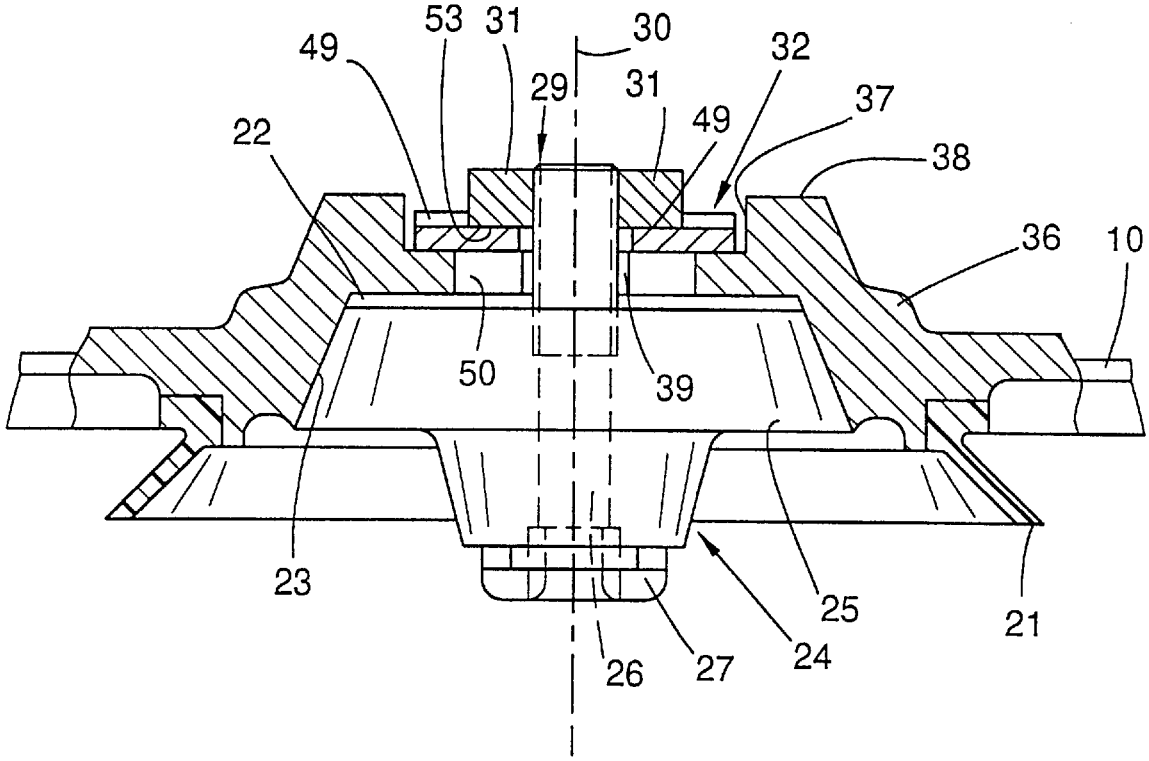
FIG. 5 is another cross-sectional view through the yarn conduit plate in the area of the fixing elements of the conduit plate adapter.

As best seen in FIG. 5, the slide 32 extends under the fixing elements 31 and draws the conduit plate adapter 24 with its insertion body 25 into the receptacle 22.

Referring now to FIGS. 6 to 8, the fixing means of the second preferred embodiment of the present invention is a double-bar spring 60. The features of the open-end spinning device of the second preferred embodiment corresponding with the features of the first preferred embodiment shown in FIGS. 1–8 are designated with the same reference numerals.

The double-spring bar 60 includes spring bars 61 and 62 which extend under the fixing elements 31 of the conduit plate adapter 24. The double-bar spring 60 is U-shaped and includes a base shank 63 which is fastened to the yarn conduit plate 10 by a clamp holder 64.

A spreading element 65 is provided for the actuation of the double-bar spring 60. The spreading element 65 is a plate 67 which can rotate about a shaft 66 and on which four vertically standing ribs 68,69,70,71 are arranged in a manner similar to turbine blades. Two opposing ribs 68, 69 are provided for spreading the spring bars 61, 62 apart into a spread or release position and the other two likewise opposing ribs 70, 71 are provided for raising the spring bars 61, 62, and thus pressing them against the fixing elements 31 into a fixed or clamping position. The ribs 71,70 include front sides 73,72, respectively and the ribs 68,69 includes side surfaces 74,75, respectively.

In the clamping position of double-bar spring 60, as shown in FIG. 6, the spring bars 61, 62 rest on the front sides 73,72 of the ribs 71,70. Since ribs 70, 71 rise up from the edge of the plate 67 toward the shaft 66, the bars 61,62 are pressed in a direction away from the yam conduit plate 10 and against the fixing elements 31 of the conduit plate adapter 24, thus holding it in the receptacle 22. The ribs 68,69 are shaped in such a manner that they extend above the spring bars 62, 61 resting on ribs 70,71 and come to rest with the side surfaces 74, 75 of the ribs 68,69 curving outward toward the adjacent spring bars 61,62.

When the spreading element 65 is rotated in a clockwise direction 77 by a toggle 76 located on the side facing away from the observer (see FIG. 8), the spring bars 61,62 are spread apart by the ribs 69 and 68 as is indicated by the arrows 78 and 79 illustrated in FIG. 6. At the same time, the spring bars 61,62 slide down on the front sides 73, 72 of the ribs 71 and 70 toward the edge of the plate 67 and cancel the clamping action on fixing elements 31.

FIG. 7 shows a maximum spread position of double-bar spring 60. The spring bars 61,62 have been drawn out from under the fixing elements 31 and thus free the conduit plate adapter 24 for replacement. The spring bars 61,62 rest under tension on ribs 68, 69 and attempt to press them out of their position. The spreading element 65 is designed so that when rotary toggle 76 is released from the actuating the spring bars 61,62 into the spread position shown in FIG. 7, the spreading element 65 is pressed automatically under the pressure of the spring bars 61,62 to return to the fixed position.

Thus, the spreading element is biased toward and normally holds the double-bar spring 60 into the fixed position. In order to limit the rotary motion of the spreading element 65, a segment 80 is cut out of the circumference of the plate 67 and a limiter 81 extends into the segment 80.

Referring specifically to FIG. 8, it can be clearly seen how the spring bars 61,62 (spring bar 61 is blocked from view by spring bar 62) are pressed by ribs 70 and 71 (rib 71 is block from view by rib 70) in the direction of the fixing elements 31.

In another preferred embodiment illustrated in FIG. 9, a conduit plate adapter 124 has, up to its extension 129, the same shape as the conduit plate adapter 24 of the preceding exemplary embodiments. The cylindrical extension 129 of the conduit plate adapter 124 follows an insertion body 125 shaped like a truncated cone, through which an extension bore 126 for the yam draw-off runs centrally to a longitudinal axis 130 of the extension 129.

The fixing element 131 is formed by an annular groove 155 which is cut into the extension 129 centrally to the longitudinal axis 130. By cutting the annular groove 155 into the extension, the fixing elements 131 then rises, like a mushroom, over the rest of the extension 129. However, the fixing elements 131 can also be formed (not shown here) by arranging two grooves parallel to one another and cutting them into extension 129. For example, the spring bars 61, 62 of the double-bar spring 60 can engage into these grooves in accordance with the second preferred embodiment according to FIGS. 6 to 8. In order to increase the clamping action, a contact surface 153 of the preferred embodiment shown in FIG. 9, which faces in the direction of a yarn draw-off jet 127, is shaped to rise in the annular groove 155 in a gentle conical fashion or tapered toward the longitudinal axis 130. The fixing of conduit plate adapter 124 can also be accomplished (not shown here) by means of a slide in accordance with the first preferred embodiment if its beveled areas are inclined, for example, toward the central axis of the slide.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. An open-end spinning device comprising:

a rotor housing having an open front side, a spinning rotor supported for rotation within the rotor housing, a yarn conduit plate for closing the open front side of the rotor housing, the yarn conduit plate defining a receptacle symmetrically formed about a receptacle axis, a conduit plate adapter removeably positioned in the receptacle and defining a mouth area of a fiber conduit guide opening into the rotor and a yarn withdrawal guide extending away from the rotor, the conduit plate adapter defining a central adapter axis, and comprising an extension having two fixing elements extending oppositely outwardly therefrom symmetrically to the adapter axis, and a fixing means for securing the fixing elements in place, the fixing means being arranged for selective movement between a first position abutting the fixing elements for fixing the conduit plate adapter within the receptacle of the yarn conduit plate and a second position releasing the conduit plate adapter from the yarn conduit plate.

2. The open-end spinning device according to claim 1, wherein the extension extends along the adapter axis and the fixing elements extend substantially orthogonally to the adapter axis and radially outwardly beyond the extension.

3. The open-end spinning device according to claim 1, wherein the extension of the conduit plate adapter includes grooves forming the fixing elements.

4. The open-end spinning device according to claim 1, wherein the fixing means comprises a slide adapted to surround the extension, the fixing elements overlying the slide at opposite sides of the extension.

5. The open-end spinning device according to claim 4, wherein the fixing elements include beveled contact surfaces and the slide includes a corresponding contact portion adapted to abut the fixing elements.

6. The open-end spinning device according to claim 5, wherein the contact portion of the slide is beveled.

7. The open-end spinning device according to claim 6, wherein the beveled contact surfaces and the beveled contact portion are compatibly shaped.

8. The open-end spinning device according to claim 4, further comprising a spring and wherein the slide is operatively connected to the spring for biasing the slide in the direction of the first position.

9. The open-end spinning device according to claim 1, wherein the fixing means comprises a double-bar spring having a first and second spring bar, the first and second spring bar being adapted to abut the fixing elements.

10. The open-end spinning device according to claim 9, wherein the double-bar spring is adjustable between a spread position in which the fixing elements are released by the double bar spring for inserting and removing the conduit plate adapter from the receptacle and a clamping position in which the fixing elements are abutted by the spring bars.

11. The open-end spinning device according to claim 10, further comprising a spreading element, the spreading element being arranged between the spring bars of the double-bar spring for movement thereof between the spread position and the clamping position.

12. The open-end spinning device according to claim 11, wherein the spreading element biases the bar springs toward one another into the clamping position.

13. The open-end spinning device according to claim 9, wherein the fixing element includes a contact surface for engaging the double-bar spring, the contact surface being tapered toward the longitudinal axis of the extension of the conduit plate adapter.

14. An open-end spinning device comprising:

a rotor housing having an open front side, a spinning rotor supported for rotation within the rotor housing, a yarn conduit plate for closing the open front side of the rotor housing, the yarn conduit plate defining a receptacle symmetrically formed about a receptacle axis, a conduit plate adapter removeably positioned in the receptacle and defining a mouth area of a fiber conduit guide opening into the rotor and a yarn withdrawal guide extending away from the rotor, the conduit plate adapter defining a central adapter axis and comprising an extension having a plurality of fixing elements arranged symmetrically to the adapter axis, and a fixing means for securing the fixing elements in place, the fixing means being arranged for selective movement between a first position engaging the fixing elements for fixing the conduit plate adapter within the receptacle of the yarn conduit plate and a second position releasing the conduit plate adapter from the yarn conduit plate, the fixing means comprising a double-bar spring having a first and second spring bar, the first and second spring bar being adapted to abut the fixing elements.

15. The open-end spinning device according to claim 14, wherein the double-bar spring is adjustable between a spread position in which the fixing elements are released by the double bar spring for inserting and removing the conduit plate adapter from the receptacle and a clamping position in which the fixing elements are abutted by the spring bars.

16. The open-end spinning device according to claim 15, further comprising a spreading element, the spreading element being arranged between the spring bars of the double-bar spring for movement thereof between the spread position and the clamping position.

17. The open-end spinning device according to claim 16, wherein the spreading element biases the bar springs toward one another into the clamping position.

18. The open-end spinning device according to claim 14, wherein the fixing element includes a contact surface for engaging the double-bar spring, the contact surface being tapered toward the longitudinal axis of the extension of the conduit plate adapter.

* * * * *